US005117075A

United States Patent [19]

Guilleminot

[11] Patent Number: 5,117,075

[45] Date of Patent: May 26, 1992

[54] RETAINING DEVICE FOR A CONTROL BUTTON MOVABLE ABOUT A PIVOT AND DEVICE IN WHICH SAME IS USED

[75] Inventor: Pierre Guilleminot, Rambouillet, France

[73] Assignee: U.S. Philips Corporation, New York, N.Y.

[21] Appl. No.: 558,115

[22] Filed: Jul. 20, 1990

[30] Foreign Application Priority Data

Jul. 21, 1989 [FR] France ..... 89 09885

[51] Int. Cl.[5] ..... H01H 13/70

[52] U.S. Cl. ..... 200/343; 200/296; 200/345

[58] Field of Search ..... 200/341, 343, 344, 345, 200/331, 339, 332, 517, 296

[56] References Cited

U.S. PATENT DOCUMENTS

| | | | |
|---|---|---|---|
| 4,096,364 | 6/1978 | Lynn et al. | 200/517 X |
| 4,181,826 | 1/1980 | Latasiewicz | 200/344 |
| 4,386,254 | 5/1983 | Eberhardt et al. | 200/339 |
| 4,387,282 | 6/1983 | Latasiewicz | 200/343 |
| 4,967,467 | 11/1990 | Udagawa | 200/343 X |

FOREIGN PATENT DOCUMENTS

| | | |
|---|---|---|
| 2148804 | 1/1973 | Fed. Rep. of Germany . |
| 7624166 | 1/1977 | Fed. Rep. of Germany . |

*Primary Examiner*—Henry J. Recla
*Assistant Examiner*—Glenn T. Barrett

[57] ABSTRACT

A control button is movable about a pivot and is fixed on a support by means of four elastic strips, two of which are interconnected by a catch which anchors itself in an opening of the support after being introduced into it.

3 Claims, 1 Drawing Sheet

RETAINING DEVICE FOR A CONTROL BUTTON MOVABLE ABOUT A PIVOT AND DEVICE IN WHICH SAME IS USED

BACKGROUND OF THE INVENTION

1. Field of the Invention

The invention relates to a retaining device for a control button on a support, which button is movable about a pivot with a rest position and an actuating position, comprising positioning means for positioning the button on the support in the rest position and returning means for returning the button to the rest position after an actuating operation consisting of pressing of the button.

2. Description of Related Art

Control and video devices, especially in car radios for achieving the various settings: treble/bass, volume, balance; such a button bears, for example, on at least a microswitch which delivers a pulse each time pressure is exerted on the button. In all cases, the retaining system of the button is subject to functional and aesthetic constraints, i.e.: a great number of operations, precision of positioning relative to the decorative front, possibility of illumination from the interior of the device, absence of mechanical noise and vibrations.

Such buttons are often present in numbers and installed side by side with mounting rods and return springs, which is complicated and expensive.

The present invention has for its object to eliminate these disadvantages.

SUMMARY OF THE INVENTION

According to the present invention, a retaining system as described in the opening paragraph is characterized in that the said support is provided with an opening in the shape of a flattened T and all through its entire thickness, the leg of the T being wide compared with its side wings, while a substantially hemispherical cavity is provided in the support above the leg of the T, in that the said button is provided with 4 contiguous strips, situated two by two in a plane substantially perpendicular to the button and consisting of an elastic material, the two central strips being sufficiently spaced from one another and a stub with a hemispherical end corresponding to the cavity in the support being accommodated there between the two central strips being moreover interconnected at their ends by a catch, the device being such that, after penetration of the lateral strips into the side wings of the T and, simultaneously, of the two central strips into the leg of the T, firstly the catch snaps itself around the support and cooperates with the stub now situated in the cavity for forming the said pivot and the said positioning means, and that secondly the two lateral strips make contact in the side wings of the T to constitute the said returning means.

Such a system based on the elasticity of the strips is simple, inexpensive and easy to mount or to dismantle.

Advantageously, the said button in addition comprises at least one lower positioning bracket of elastic material, substantially perpendicular to the button and provided with a snap catch for precisely determining the rest position in cooperation with an opening of the support.

Thus the elastic strips of the button are subjected to a pre-tensioning which has the result that on the one hand play and the ensuing mechanical noises are eliminated in case of vibration, and on the other hand that a perfect reproducibility of the rest position is guaranteed.

Preferably, the system is so designed that the actuating positions are three in number: left, right, and center, and that the centre actuating position corresponds to the simultaneous combination of the right and left actuating positions.

Thus, for example, by pressing on the right a first microswitch is activated, by pressing on the left a second microswitch is activated, and by pressing in the centre the two microswitches are activated simultaneously.

BRIEF DESCRIPTION OF THE DRAWINGS

The invention will now be explained in more detail with reference to an embodiment illustrated in the following drawings.

DETAILED DESCRIPTION OF THE PREFERRED EMBODIMENTS

Figure 1:
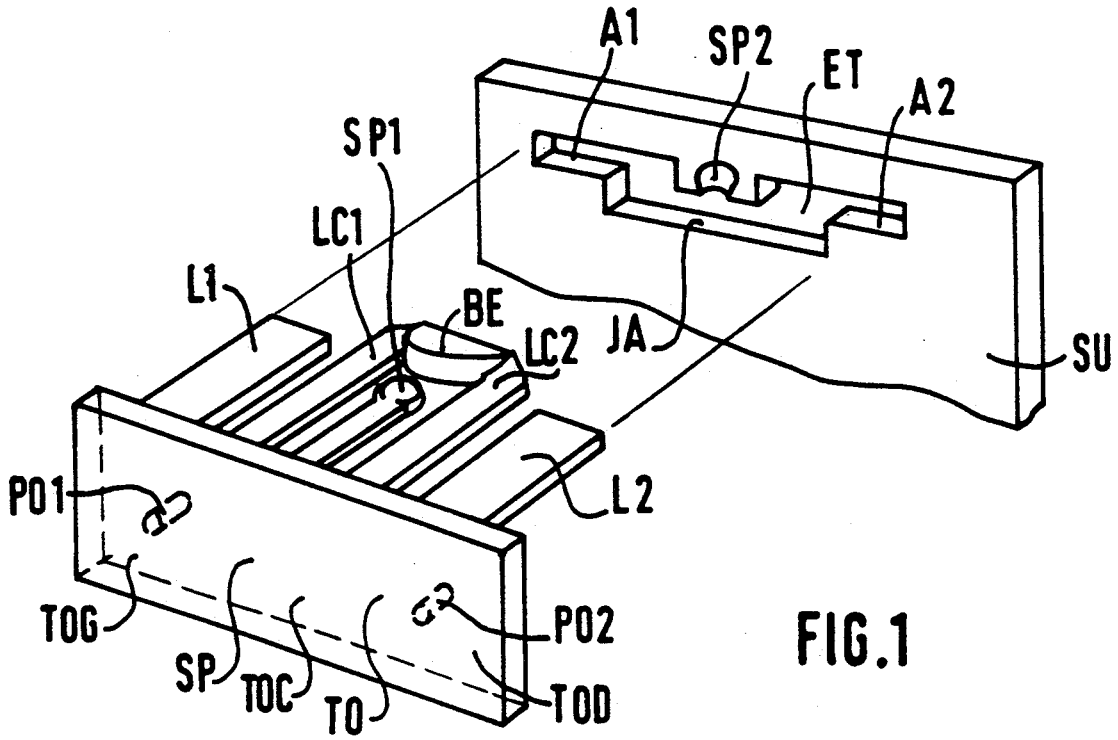
FIG. 1 depicts the inventive button and the support when disassembled.

In FIG. 1, the button TO and its support SU are shown before being assembled together.

The support SU comprises an opening ET in the shape of a flattened T through its entire thickness.

The button TO is operated by exertion of pressure on the flat surface SP; obviously, this surface may have an outward appearance other than that represented.

The button TO is provided with 4 strips L1, LC1, LC2, L2 which lie side by side two by two—L1, LC1 and LC2, L2—, substantially perpendicular to plane SP of the button and consisting of an elastic material which imparts a certain flexibility to them relative to the surface SP of the button. In practice, the entire button is of a synthetic material injection-moulded in one piece, the surface SP having an adequate thickness for it to be sufficiently rigid.

The outermost strips L1, L2 are so dimensioned that they will enter the side wings A1, A2 of the cavity ET of support SU with the smallest possible play in their thickness direction.

The strips LC1, LC2 are interconnected at their ends by a bevelled catch BE which is so designed that, after entering the leg JA of the cavity ET, it will anchor itself against the rear surface of the support SU.

The strips LC1, LC2 are sufficiently spaced apart in order to allow a stub SP1 of hemispherical shape, which is rigidly connected to the button, to be present in between.

Similarly, the support comprises above the leg of the T a hemispherical cavity SP2 provided in the thickness of the support and so designed that, when the button is inserted in the support, the two hemispherical elements SP1, SP2 cooperate to form the pivot about which the button may be operated. The pivot and the catch BE, after reaching its retaining position, form the retaining and positioning means of the button in the rest position.

The strips L1, L2 also cooperate in determining the rest position, but they chiefly from the returning means by bearing on the side wings A1, A2 of the T during an actuating operation.

Figure 2:
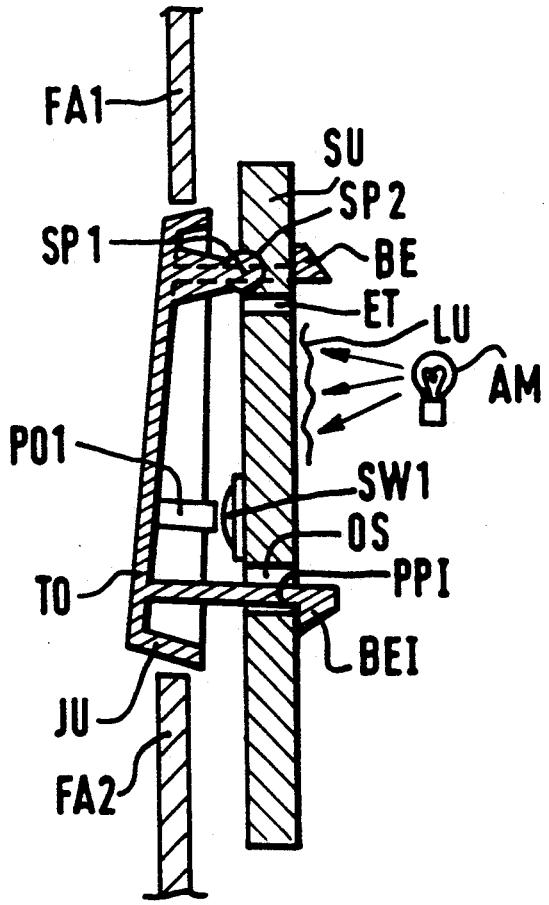
FIG. 2 depicts, in cross-section, the inventive button and support when assembled.

FIG. 2 shows in cross-section the assembled system in the rest position.

The support SU is visible with its hemispherical cavity SP2 and part of the cavity ET.

The button TO is visible with its stub SP1 and its catch BE in the retaining position, while the strip LC1 is shown in broken lines.

In order to make the aesthetic problem better understood, a decorative front FA1, FA2 is shown, while the button comprises a skirt JU.

It is important that the overlap of the button relative to the front is practically constant from one button to another, and from one device to another. To this end, a lower positioning bracket PPI is provided, which is elastic, like the strips, and comprises a retaining catch BEI which is to enter an additional opening OS of the support. The length of the bracket PPI up to its catch BEI is such as to guarantee a perfectly reproducible positioning of the button int he rest position; the rest position can be designed in such a way that the strips L1 and L2 are lightly pre-tensioned, which above all eliminates any play and prevents mechanical noises in the case of vibration.

The retaining system described above provides a button which is elastically movable about a pivot and which has a rest position.

It is possible to provide, preferably but not limitatively, three actuating positions:

In FIG. 1, the button is provided with two actuating stubs PO1 and PO2, of which stub PO1 is visible in FIG. 2 opposite a microswitch SW1; similarly, a switch SW2 is placed opposite stub PO2.

When the button is pressed on its left-hand portion TOG, the switch SW1 only is activated. When the button is pressed on its right-hand portion TOD, the switch SW2 only is activated. When the switch is pressed on its central portion TOC, both switches SW1 and SW2 are simultaneously activated.

The word switch is not to be taken as limitative, since it is obvious that any kind of device, such as metallic foils, dome contacts, etc. . . . may be activated with the pivoted button described, which button provides a path of a few millimetres for activating a device of whatever nature.

As an indicative example, such a retaining system has been realised with a button of 30×15 mm made of synthetic material with strips having a thickness of 0.7 mm, a width of 2.5 mm, and a length of 6 mm.

It is to be noted that the retaining system according to the invention occupies little space and thus renders it possible to illuminate the button from behind with, for example, a light bulb AM.

It is sufficient for this that the support zone marked LU is empty, or translucent, so that the light emitted by the bulb AM illuminates the button from behind to render visible an inscription or a picture.

I claim:

1. A control button in combination with a support for the button, such that the button is movable about a pivot and has a rest position and an actuating position, the combination further comprising positioning means for positioning the button on the support in the rest position and returning means for returning the button to the rest position after movement to said actuating position, characterized in that said support includes a flattened T-shaped opening extending through said support, said T-shaped opening including a leg and two side wings such that the leg of said opening is wide compared to said side wings, a substantially hemispherical cavity is provided in the support above the leg of the T-shaped opening, and said button includes four continuous strips of elastic material, situated as two central strips and two lateral strips in a plane substantially perpendicular to a front surface of the button, the two central strips having end portions and being sufficiently spaced from one another such that a stub extending from said button and having a hemispherical end corresponding to the hemispherical cavity in the support is accommodated therebetween, the two central strips being moreover interconnected at their end portions by a catch, the button being configured such that, after penetration of the lateral strips into the side wings of the T-shaped opening and, the two central strips into the leg of the T-shaped opening, the catch snaps around the portion of the support which cooperates with the stub now situated in the cavity forming said pivot and said positioning means, and the two lateral strips contact the side wings of the T-shaped opening forming said returning means.

2. A button as claimed in claim 1 also comprising at least one lower positioning bracket of elastic material, substantially perpendicular to the front surface of the button and provided with a snap catch for precisely determining the rest position in cooperation with an opening of the support.

3. A button as claimed in claim 1, having a left side and a right side with a center between the sides, said button being operable to an actuating position by pressing the left side, the right side and the center, and wherein pressing the center is the equivalent of simultaneously pressing the left side and the right side.

* * * * *